US005195690A

United States Patent [19]

Cross et al.

[11] Patent Number: 5,195,690

[45] Date of Patent: Mar. 23, 1993

[54] FABRIC HANDING APPARATUS HAVING VARIABLE SPEED FABRIC TRAVEL

[75] Inventors: Andrew L. Cross, Mantua; Frank Albert, Jr., Parma, both of Ohio

[73] Assignee: Cleveland State University, Cleveland, Ohio

[21] Appl. No.: 775,519

[22] Filed: Oct. 15, 1991

[51] Int. Cl.[5] ..... B65H 16/10; B65H 20/00; B65H 20/30; B65H 23/185

[52] U.S. Cl. ..... 242/67.2; 242/45; 242/67.3; 242/75.51; 226/44; 226/118

[58] Field of Search ..... 242/62, 67.2, 67.3, 242/75.5, 75.51, 45; 226/118, 119, 44, 45

[56] References Cited

U.S. PATENT DOCUMENTS

| | | | |
|---|---|---|---|
| 1,673,521 | 6/1928 | Maas | 242/75.51 X |
| 3,055,606 | 9/1962 | Alden | 242/67.3 X |
| 3,825,198 | 7/1974 | Oehninger | 226/118 X |

*Primary Examiner*—Stanley N. Gilreath
*Attorney, Agent, or Firm*—John F. McDevitt

[57] ABSTRACT

Fabric handling apparatus is provided to continuously unwind a fabric sheet being supplied from a supply roll at variable travel speeds for subsequent processing operations. The fabric sheet being unwound is accumulated in storage means enabling the fabric travel speed to be automatically and continuously decreased as fabric is being accumulated while also being automatically and continuously increased as the fabric sheet is being withdrawn from storage.

5 Claims, 1 Drawing Sheet

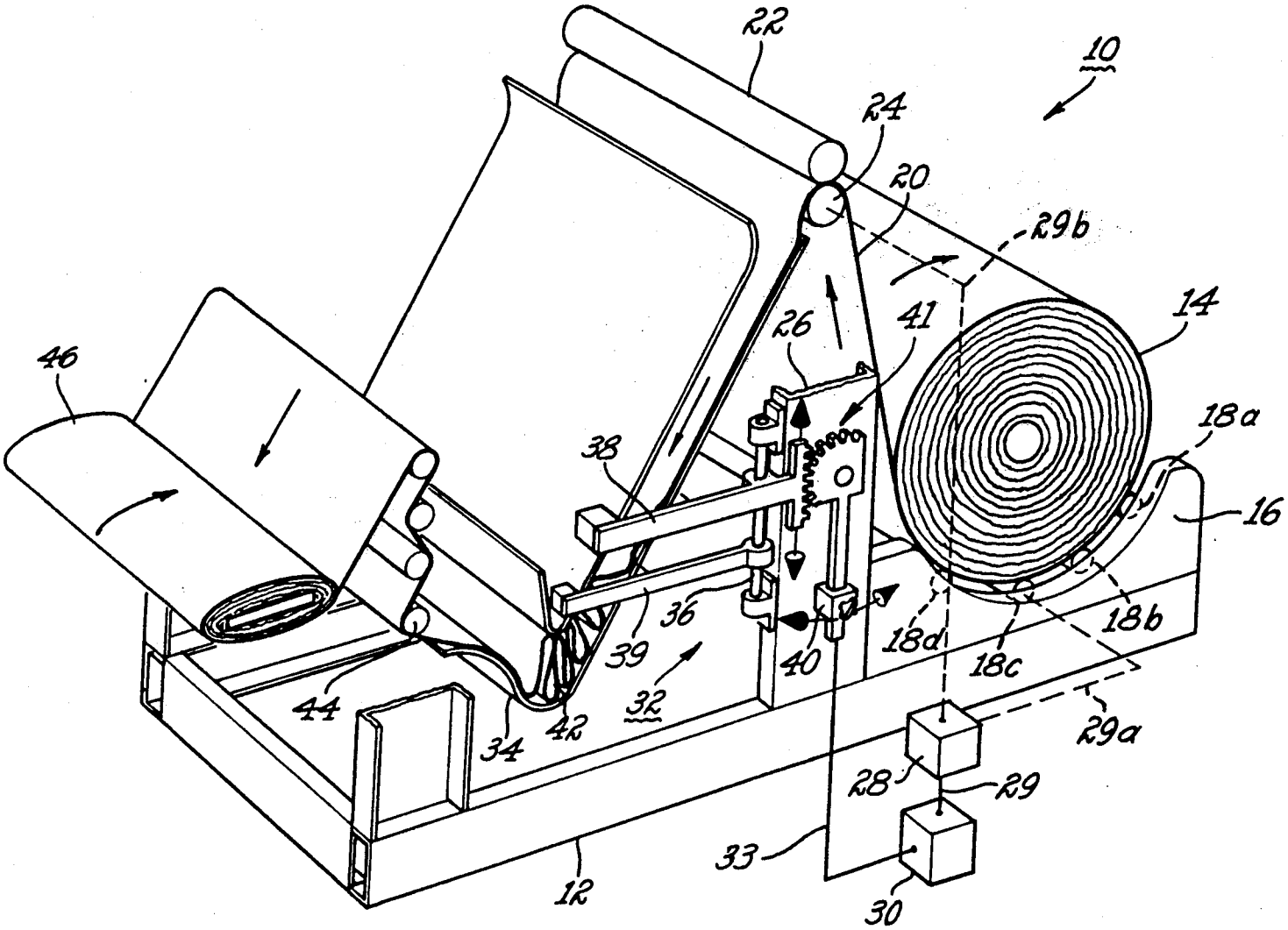
10
14
16
18a
18b
18c
18d
29a
29b
29
28
30
20
24
22
41
26
40
33
36
32
39
38
42
34
12
44
46

FABRIC HANDING APPARATUS HAVING VARIABLE SPEED FABRIC TRAVEL

BACKGROUND OF THE INVENTION

This invention relates generally to apparatus means enabling a fabric sheet to be continuously unwound from a supply roll at variable fabric travel speeds for subsequent fabric processing operations and more particularly to the apparatus means for doing so in a continuous automatic controlled manner.

Fabric handling machines commonly supply a fabric sheet from a supply roll at a constant fabric travel speed established by feed rolls. Problems are often encountered at such constant fabric travel speed by reason of a random fabric accumulation now occurring in the conventional handling apparatus which can produce defects in the fabric being subsequently processed. Apparatus means regulating the rate of fabric supplied during processing are also known. For example, a known fabric folding apparatus adjusts the fabric travel speed by operator manipulation of a control device which operates an electric motor drive utilizing a potentiometer means. In a different type fabric handling apparatus, the speed of textile material being supplied is automatically regulated in direct response to the speed of the take-up of such material. The latter apparatus is said to maintain a preselected speed ratio between the cloth take-up and the cloth being delivered from a supply roll utilizing a depth measurement in the loop of fabric being supplied. Cam and follower means are employed in said speed control arrangement causing a servomotor to make any needed adjustment in the supply roll speed.

It remains desirable to regulate fabric travel speed during processing in a fabric handling apparatus by still more direct and effective means. More particularly, it becomes desirable to have the rate of fabric being supplied respond immediately and directly to the demand rate of fabric being further processed. It is also desirable to have such improved response be carried out with simpler feed control means. Similarly, it is also desirable to continuously control the fabric feed by automated apparatus means dependent solely upon varying demand rates of fabric processing.

It is one object of the present invention to provide more effective means whereby fabric movement is controlled in a fabric handling apparatus.

It is another object of the present invention to provide a novel control mechanism enabling continuous and automatic adjustment of fabric travel speed in a fabric handling apparatus.

Still another object of the present invention is to provide apparatus control means for adjustment of fabric travel speed in a fabric handling apparatus which automatically decreases the fabric travel speed as fabric is being accumulated during processing in novel storage means while also automatically increasing the fabric travel speed as fabric is being withdrawn therefrom.

These and still further objects of the present invention will become apparent upon considering the following detailed description of the present invention.

SUMMARY OF THE INVENTION

Novel control means have now been discovered to automatically adjust the fabric travel speed when being processed in a fabric handling apparatus. Generally, the present fabric handling apparatus comprises a supply roll providing fabric sheet to said apparatus, first variable speed roller means physically supporting said supply roll, second variable speed roller means operatively associated with said first roller means and being operated so as to cause a faster fabric travel speed relative to said first roller means, drive means regulating the fabric travel speed provided with said roller means, and fabric accumulator means operatively associated with said drive means so as to automatically decrease the fabric travel speed as fabric is being accumulated while also automatically increase fabric travel speed as fabric is being withdrawn therefrom. In one type apparatus providing fabric sheet to said apparatus for operator rewinding on a plurality of smaller diameter rolls, the particular fabric accumulator means being employed utilizes a movable counterbalanced storage member affixed to the apparatus so as to develop control signals for the drive means. In a different embodiment for said type apparatus, the fabric accumulator means being employed features a pivoting counterbalanced storage member affixed to the apparatus with potentiometer means providing the control signals.

BRIEF DESCRIPTION OF THE DRAWING

The accompanying drawing provides a perspective view of a representative apparatus according to the present invention.

DETAILED DESCRIPTION OF THE PREFERRED EMBODIMENTS

Referring to the accompanying drawing, there is shown a perspective view for a representative fabric handling apparatus 10 enabling automatic adjustment of the fabric speed when being processed in an improved manner. A frame assembly 12 is provided from which a supply roll 14 of the fabric is rotatably mounted on a cradle 16 of cooperating first roller means 18*a*, 18*b*, 18*c* and 18*d*. Fabric sheet 20 is supplied to a pair of operatively associated second roller means 22 and 24 arranged in a pinch-seal engagement and which are physically secured to a suspension member 26 provided in the frame assembly. A conventional variable speed D.C. motor 28 drives both first and second roller means in accordance with control signals 29 being derived with the motor speed control means 30 to be described hereinafter in greater detail. Direct connection of motor 28 to first roller means 18*a*–18*c* is made with conventional gearing or chain arrangements as shown by dashed line 29*a* in the present drawing whereas further included dashed line 29*b* depicts a like interconnection to second roller means 22–24. As can further be seen in the present drawing, the roller diameters in the second roller means are slightly larger relative to the roller diameters of the first roller means so as to provide constant tension on the fabric sheet being transported with a minimum of fabric stretch. Understandably, other conventional means are contemplated to provide such degree of cooperation between the operatively associated roller means to include gearing, sprocket-chain drives and the like. The moving fabric sheet 20 is continuously delivered from the second roller means 22 and 24 to movable accumulator means 32 which derive the control signals 33 operating the speed control means 30. The depicted accumulator means 32 employs a trough member 34 slidably-mounted on a shaft 36 secured to suspension member 26 with a pair of horizontal support arms 38 and 39 to permit vertical movement. A counterbalancing mechanism 40 is further fixedly connected to support arm 38 with a rack and pinion gearing arrangement 41 as a means for equalizing vertical movement of the trough member. As fabric continues to fall into the trough member by gravity action, the weight of accumulated fabric 42 causes said trough member to descend and derive the desired control signals 33. Such control signals 33 can be generated with various conventional means (not shown) to include known gearing arrangements connected to a potentiometer device. Any subsequent removal of fabric from said trough member causes its upward movement accompanied by control signals 33 of an opposite nature. Automatic regulation of the fabric travel speed proceeds with the illustrated control whereby the control signals 33 being generated by vertical movement of trough member 34 and the directly connected counterbalancing mechanism 40 serve as input signals to the motor speed control means 30 and with said motor speed control means responding thereto for generation of output control signals 29 regulating the speed of roller drive motor 28. In a different contemplated embodiment for the present fabric accumulator means, the support arm 38 having trough member 34 and counterbalancing mechanism 40 at opposite ends can be pivotally-mounted about a central fulcrum (not shown) suitably secured to the frame assembly. Though movement responsive to fabric accumulation and withdrawal will Cause tilting Of the trough member in opposite directions thereby deriving the appropriate control signals. Fabric withdrawal from trough member 34 is also shown to be proceeding continuously in the present drawing. Specifically, the fabric sheet 20 being removed from said trough member is delivered to optional alignment means 44. The latter means can be provided with a plurality of stationary rods angled in opposite directions. Upon emerging from these alignment means, the fabric sheet exits the fabric handling apparatus 10 for rewinding by an operator (not shown) on smaller diameter rolls or flat battens 46. Fabric movement in said apparatus is adjusted to demands by the rewind operator with the fabric being supplied under minimum tension. As fabric is removed from trough member 34, the drive means 28 speeds up increasing fabric travel speed for replenishment in the trough member. Conversely, fabric travel speed is reduced in said apparatus as the trough member fills and with said drive means possibly being suspended while the trough member remains full. At high rates of fabric demand it can further prove desirable to maintain fabric travel speeds in the depicted apparatus so as to keep the trough member filled with fabric.

The control signals 29 causing the drive means 28 of the present apparatus to increase or decrease fabric travel speed can also be provided by various already available electrical circuit means. For example, the motor speed control unit 30 can simply employ conventional limit switch means alone or in combination with available acceleration/deceleration type electrical circuits. The latter type control mechanism enables immediate motor acceleration to a motor speed rate satisfying the fabric supply demands followed by immediate motor deceleration when said supply demands have been met. An average rate of fabric demand can also be employed in the derivation of such control signals.

Typical operation of the above described apparatus embodiment provides continuous fabric accumulation experiencing far less wrinkles and other peculiarities now being experienced with conventional fabric handling equipment For example, in a customary utilization of the double-fold type fabric handling equipment, an apparatus now being sold by the Measuregraph Company is now used for unwinding 20" diameter cloth rolls and subsequent rewinding on smaller diameter rolls or flat battens. A simplification of this equipment to include the above illustrated fabric accumulator means has a number of economic advantages. The more uniform festooning of fabric achieved with the present accumulator means virtually eliminates any need for operator intervention to continuously supply a smooth flow of fabric sheet when occasioned by the rewind operator. Surprisingly, there is a further economic advantage achieved with said improved fabric accumulator which now allows much larger diameter fabric supply rolls up to 48" diameter to be processed on the presently modified equipment without further modification. In doing so, such larger diameter supply rolls can be continuously processed in the modified apparatus with the illustrated second variable speed roller means being driven 1–2 percent faster than the first variable speed roller means. As the fabric sheet is being thereby fed continuously to the present accumulator means under constant tension with a minimum of fabric stretch, there is produced movement of the illustrated counterbalanced storage member to produce control signals slowing the drive means for the fabric supply roll. As fabric is withdrawn from the present accumulator means upon demand by the rewind operator, control signals causing said drive means to increase are also occasioned. Utilizing the previously mentioned acceleration/deceleration circuit means for motor speed regulation in the present apparatus has also been found to reduce tension upon the fabric when conducting the herein illustrated fabric handling operation.

To still further explain one contemplated mode for operation of the above described apparatus, an average rate of fabric demand, such as fabric yards per hour, is first established from the variable intermittent demand being exercised by the rewind operator. A motor speed range satisfying said fabric demands is next established for the potentiometer device controlling motor speed and with settings for said potentiometer device being made further dependent upon the amount of fabric then stored in the present accumulator means. The highest motor speed setting for said potentiometer device occurs if the present accumulator means is empty with said potentiometer settings being continuously and automatically adjusted to provide lower motor speeds as the fabric accumulates. In a like manner, motor speed increases also occur at higher speed settings of said potentiometer device when dictated by withdrawals of the accumulated fabric. Still further automatic motor speed adjustment can be optionally provided in the present apparatus since various fabric weights per yard are often encountered. To compensate for such fabric variation, the counterbalancing mechanism for the present accumulator means can be provided as an adjustable counterweight device to be manually adjusted by an operator for the particular fabric being handled.

It will be apparent from the foregoing description that broadly useful and novel means has been provided to regulate fabric movement in a fabric handling apparatus. It is contemplated that further modifications can be made in the specific apparatus embodiments herein illustrated, however, without departing from the spirit and scope of the present invention. For example, other type fabric alignment means can be incorporated in said apparatus, if desired, such an as alignment means to center the fabric supply roll along the central axis of said apparatus. Supplemental gear drive means can also be incorporated in the present apparatus to reverse payoff direction of the fabric supply roll, if desired. Thus, a clockwise payoff direction of said supply roll, as employed in the illustrated apparatus embodiments, can be altered to provide counterclockwise rotation with conventional gearing arrangements. Consequently, it is intended to limit the present invention only by the scope of the appended claims.

What we claim as new and desire to secure by Letter Patent of the United States is:

1. A fabric handling apparatus comprising:

(a) a fabric supply roll rotatably supported on first variable speed roller means to deliver a moving fabric sheet at first travel speed, (b) second variable speed roller means receiving the moving fabric sheet from the first variable speed roller means and being operated to impart a faster fabric travel speed than the first variable speed roller means, (c) variable speed electric motor drive means connected to both first and second variable speed roller means for continuous regulation of the fabric travel speed, (d) fabric accumulator means having a slidably mounted counterbalanced trough member to receive the moving fabric sheet being delivered from the second variable speed roller means by gravity action, the trough member being caused to move downward by the weight of the accumulated fabric sheet while being caused to move upward when the accumulated fabric sheet is removed therefrom, (e) movable counterbalancing weight means fixedly connected to the trough member for counterbalancing the trough member and the accumulated fabric sheet, the counterbalancing weight means including means for producing control signals in response to movement of the counterbalancing weight means and trough member, and (f) motor speed control means responding to the control signals from the movable counterbalancing weight means so that upward movement of the trough member automatically and continuously increased fabric travel speed whereas downward movement of the trough member automatically and continuously reduces fabric travel speed.

2. The apparatus of claim 1 wherein the second roller means comprises a pair of rollers cooperating in pinch engagement.

3. The apparatus of claim 1 wherein the counterbalancing means is adjustable.

4. The apparatus of claim 1 wherein the counterbalancing means provides control signals to a single electric motor serving as the drive means.

5. The apparatus of claim 5 wherein the first variable speed roller means comprises a plurality of cooperating rollers for peripheral support of the fabric supply roll.

* * * * *